US005263849A

United States Patent [19]

Irwin et al.

[11] Patent Number: 5,263,849

[45] Date of Patent: Nov. 23, 1993

[54] HIGH VELOCITY BURNER, SYSTEM AND METHOD

[75] Inventors: Bruce C. Irwin, Palmyra; Edward E. Moore, Hummelstown; Richard A. Carpenter, Cornwall, all of Pa.

[73] Assignee: Hauck Manufacturing Company, Lebanon, Pa.

[21] Appl. No.: 810,847

[22] Filed: Dec. 20, 1991

[51] Int. Cl.[5] ..... F23C 7/00

[52] U.S. Cl. ..... 431/6; 431/1; 431/10; 431/181; 431/187

[58] Field of Search ..... 431/6, 8, 9, 10, 164, 431/165, 166, 167, 162, 163, 181, 187, 188

[56] References Cited

U.S. PATENT DOCUMENTS

| | | | |
|---|---|---|---|
| 1,769,853 | 7/1930 | Orth . | |
| 1,912,243 | 5/1933 | Andrews . | |
| 2,986,206 | 5/1961 | Boelsma | 431/9 X |
| 3,119,436 | 1/1964 | Rydberg . | |
| 3,514,244 | 5/1970 | Meyer et al. | 431/164 |
| 3,729,285 | 4/1973 | Schwedersky . | |
| 4,004,875 | 1/1977 | Zink et al. . | |
| 4,021,188 | 5/1977 | Yamagishi et al. . | |
| 4,023,921 | 5/1977 | Anson . | |
| 4,030,874 | 6/1977 | Vollerin . | |
| 4,083,677 | 4/1978 | Hovis | 431/90 X |
| 4,289,474 | 9/1981 | Honda et al. . | |
| 4,297,093 | 10/1981 | Morimoto et al. . | |
| 4,357,134 | 11/1982 | Katsushige et al. . | |
| 4,408,982 | 10/1983 | Kobayashi et al. . | |
| 4,439,137 | 3/1984 | Suzuki et al. | 431/8 |
| 4,496,306 | 1/1985 | Okigami et al. . | |
| 4,511,325 | 4/1985 | Voorheis | 431/8 X |
| 4,629,413 | 12/1986 | Michelsons et al. | 431/10 X |
| 4,659,305 | 4/1987 | Nelson et al. . | |
| 4,741,279 | 5/1988 | Azuhata et al. . | |
| 4,784,600 | 11/1988 | Moreno . | |
| 4,810,186 | 3/1989 | Rennert et al. . | |
| 4,842,509 | 6/1989 | Hasenack . | |
| 4,846,665 | 7/1989 | Abbasi . | |
| 4,867,674 | 9/1989 | Keller et al. . | |
| 4,927,349 | 5/1990 | Schirmer et al. . | |
| 4,938,684 | 7/1990 | Karl et al. . | |
| 4,954,076 | 9/1990 | Fioravanti et al. | 431/10 X |
| 4,957,050 | 9/1990 | Ho . | |
| 4,959,009 | 9/1990 | Hemsath . | |
| 4,988,285 | 1/1991 | Delano . | |
| 4,995,807 | 2/1991 | Rampley et al. . | |
| 5,002,483 | 3/1991 | Becker . | |

FOREIGN PATENT DOCUMENTS

| | | | |
|---|---|---|---|
| 0102822 | 8/1980 | Japan | 431/164 |

OTHER PUBLICATIONS

"SVG Super Velocity Gas Burner Series" Brochure, Mar. 1991, Hauck Manufacturing Co. Lebanon Pa.

SVG Super Velocity Gas Burner Dimension spec. sheeet, SVG-3, Mar. 1991, Hauck Manufacturing Co., Lebanon Pa.

SVG Super Velocity Gas Burner spec. sheet parts list, SVG-6, pp. 1-2, Apr. 1991, Hauck Manufacturing Co. Lebanon Pa.

*Primary Examiner*—Carl D. Price

*Attorney, Agent, or Firm*—Evenson, McKeown, Edwards & Lenahan

[57] ABSTRACT

A burner and burner firing method and system for a furnace combustion chamber in which a burner, having an ignition chamber for discharging an ignited combustible mixture of primary air and fuel into the furnace combustion chamber, and a plurality of nozzle ports for directing a high velocity stream of secondary air into the furnace combustion chamber in a direction generally parallel to the direction of flow from said ignition chamber, is operated in a first mode at furnace combustion chamber temperatures up to a transitional temperature by accelerating a burning mixture of fuel and air to moderately high velocities into the furnace combustion chamber, and in a second mode at furnace combustion temperatures above said transitional temperature by introducing a relatively low velocity stream of fuel mixed with a minor amount of air needed for stoichiometric combustion and accelerating a separate stream of air to high velocities into the furnace combustion chamber for mixture with said low velocity stream downstream from the burner in the furnace combustion chamber, said separate stream of air comprising the remainder of air required for stoichiometric combustion of the fuel. The system includes fuel supply and separately controlled primary and secondary air supply flow lines in which the fuel/air ratio in the respective modes of operation is dependent on air flow rates.

17 Claims, 5 Drawing Sheets

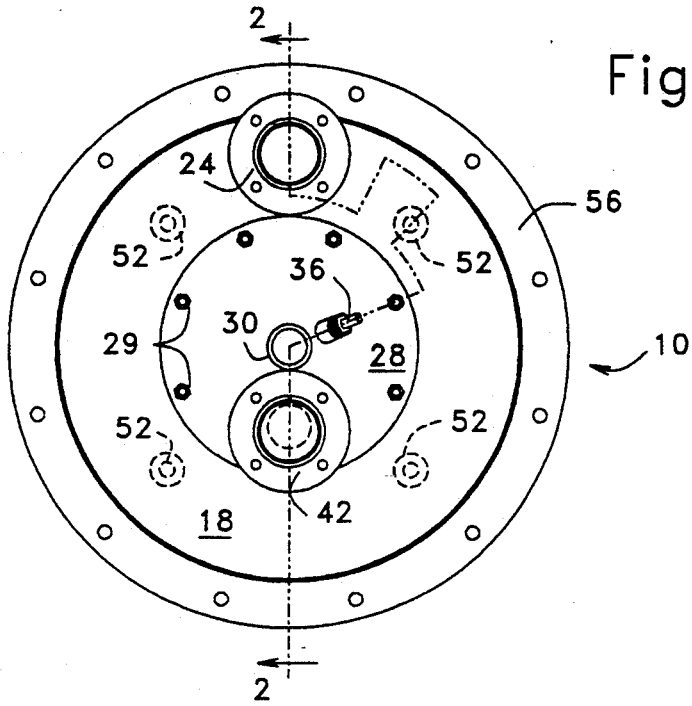
Fig. 1
Fig. 2
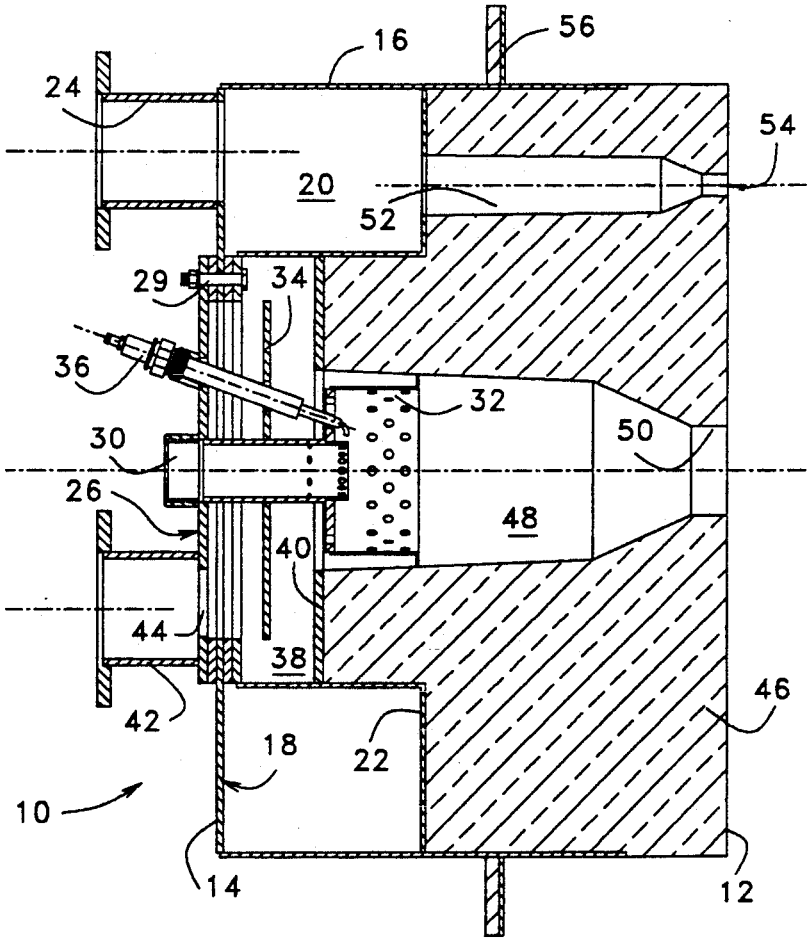

| PARAMETERS | MODE A | MODE $B_f$ | MODE $B_p$ |
|---|---|---|---|
| FUEL | 362 | 410 | 205 |
| PRIMARY AIR | 4050 | 350 | 182 |
| SECONDARY AIR | NONE | 4300 | 2150 |
| PRESS. PRI. MAN. | 27.9" | 0.9" | 0.9" |
| PRESS. SEC. MAN. | 0.0" | 28.2" | 28.2" |

HIGH VELOCITY BURNER, SYSTEM AND METHOD

BACKGROUND OF THE INVENTION

The present invention relates to high velocity burner firing of furnace combustion chambers and, more particularly, it relates to a burner and burner firing method and system by which the formation of nitrogen oxides ($NO_x$) is reduced at substantially all levels of burner heating capacities.

Techniques for controlling and inhibiting $NO_x$ formation in furnace combustion processes are well known and may include, for example, provisions for staging fuel, staging combustion air, recirculating flue gas into the burner, recirculating flue gas into the burner flame, altering combustion patterns with different degrees of swirl, and injection of water or steam into the burner or flame. Factors which contribute to the formation of $NO_x$ in burner fired combustion chambers are the oxygen content of the flame or combustion chamber, the temperature of the combustion chamber and the burner firing rate. It is known that the $NO_x$ increases with combustion chamber temperature and with oxygen content in the combustion chamber. However, these factors are difficult to predict because burners for different industrial processes must operate at various furnace chamber temperatures, have various oxygen concentrations in the work chambers, and are required to operate at different heat inputs depending of changing heat load requirements.

Most modern industrially available burners that are known as "high velocity burners" are relatively low $NO_x$ producers because, at the higher firing rates of such burners, large amounts of combustion chamber or flue gasses are entrained into the burner flames. As a result, not only is localized high flame temperature reduced, but also, flue gas is directed into and mixed with the flame of the burning combustible mixture. This effect becomes less pronounced at reduced or low fire flow rates of fuel and air since there is less kinetic energy to entrain the furnace gasses into the flame and to stir the furnace work chamber flue gasses for best furnace temperature uniformity. In addition, flames at minimum flow rates also are usually smaller and do not occupy an adequate percentage of furnace chamber volume to ensure the induction of flue gasses into the flame to lower the formation of $NO_x$.

In a commercially available, high velocity gas burner manufactured and sold by Hauck Manufacturing Co. of Lebanon, Pennsylvania, the assignee of the present invention, under the designation "Burner Model SVG 115," furnace combustion chamber temperatures developed by the burner are controlled through frequency modulation of burner firing between full capacity firing rates and pilot firing rates. Pilot firing rates, in this context, are those in which an adequate small amount of fuel and air is supplied to the burner for maintaining ignition but without development of meaningful furnace chamber heat. By such on/essentially-off operation, the kinetic energy of burning gases accelerated from the burner entrains flue gases into the burning gas and inhibits the formation of localized high temperature and/or oxygen-rich regions in the burning gases. As a result $NO_x$ formation is reduced substantially by comparison to continuous burner firing at varying rates of fuel and air supply for temperature control purposes.

It is also known that $NO_x$ formation can be reduced by staging the air supply to a gas burner in a manner so that mixture of fuel and a substoichiometric quantity of air is ignited and discharged for complete combustion supported by secondary air mixed with the burning gases downstream from the burner. An example of such a staged air supply gas burner is disclosed in U.S. Pat. No. 4,021,188 issued May 3, 1977 to Kazuo Yamagishi et al. While the disclosure of this patent includes many variations of nozzle structures for attainment of low $NO_x$ formation using staged burner air supply, only one mode of burner operation is described and no disclosure is made of controlling or varying the heating capacity of the burner.

The present invention has been made in view of the above circumstances and has as an object the provision of a high velocity burner construction by which the formation of $NO_x$ in a furnace combustion chamber fired by the burner is reduced throughout a wide range of furnace combustion chamber temperatures.

A further object of the present invention is to provide a system for the supply of fuel and air to such a burner.

Another object of the present invention is the provision of a method of operating such a system and burner.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the low $NO_x$ burner method and system of this invention comprises operating the burner in a first mode at furnace combustion chamber temperatures up to a transitional temperature by accelerating a burning mixture of fuel and air to moderately high velocities into the furnace combustion chamber to ensure a mixing of flue gases with the burning mixture of fuel and air, and operating the burner in a second mode at furnace combustion temperatures above the transitional temperature by introducing into the combustion chamber, a relatively low velocity stream of burning fuel mixed with a minor amount of air needed for stoichiometric combustion and accelerating a separate stream of air to high velocities into the furnace combustion chamber for mixture with the low velocity stream downstream from the burner in the furnace combustion chamber, the separate stream of air comprising the remainder of air required for stoichiometric combustion of the fuel.

The invention is further embodied in a high velocity burner system for furnace combustion chambers, the system including a burner having an ignition chamber for discharging an ignited combustible mixture of primary air and fuel into the furnace combustion chamber, and at least one nozzle port for directing a high velocity stream of secondary air into the furnace combustion chamber in a direction generally parallel to the direction of flow from the ignition chamber, means for supplying fuel to the ignition chamber, means for supplying primary air to the burner during plural modes of burner operation including a first mode during which primary air alone is supplied to the ignition chamber and a second mode during which primary air is a minor percentage of air used for combustion of fuel supplied to the burner, means for supplying to the combustion chamber, secondary air in amounts constituting a major percentage of air used for combustion of fuel during the second mode, means for regulating the fuel supplying means so that fuel supply to the burner is dependent on operation of one of the primary air supplying means alone and both the primary air supplying means and the secondary air supplying means together to supply air to the burner, and means for controlling the firing rate of the burner at least during the second mode including secondary valve means for intermittently terminating operation of the secondary air supplying means for variable periods of time.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention. In the drawings, FIG. 1 is an end elevation of a burner used in the present invention;

FIG. 2 is an enlarged cross section on line 2—2 of FIG. 1;

DETAILED DESCRIPTION OF THE PREFERRED EMBODIMENT

Figure 3:
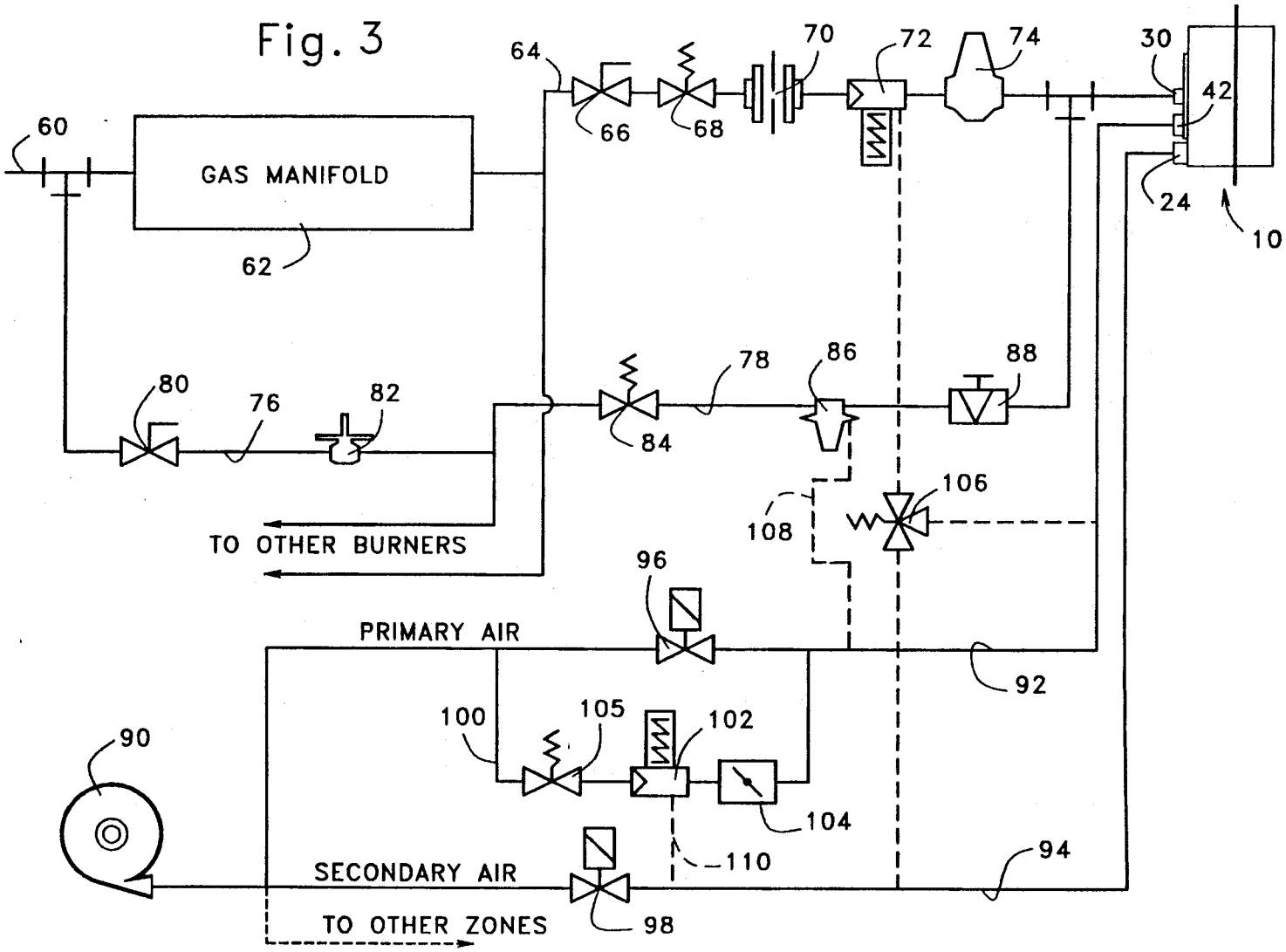
FIG. 3 is a schematic diagram illustrating the fuel supply system of the present invention.

Reference will now be made in detail to the present preferred embodiment of the invention, an example of which is illustrated in the accompanying drawings. Wherever possible, the same reference numbers will be used throughout the drawings to refer to the same or like parts.

In FIGS. 1 and 2 of the drawings, an embodiment of a burner of the present invention is generally designated by the reference numeral 10 and shown to be of generally cylindrical configuration with front and rear ends 12 and 14, respectively. The burner 10 includes a peripheral shell 16 open at its forward end and closed at its rearward end by a generally circular rear end wall assembly 18. At the rear end of the burner 10, an annular secondary air manifold 20 is formed in part by the shell 16 and the outer region of the end wall 18 and in part by an annular hat shaped member 22 sealed at its outer periphery to the inner surface of the shell 16. An air inlet port to the manifold 20 is provided by a flanged nipple 24 opening through the end wall 18.

Within the secondary air manifold 20, a fuel supply and igniting assembly, generally designated by the reference numeral 26, is shown to include a generally circular mounting plate 28 secured, such as by bolts 29, about a central aperture in the end wall assembly 18. A fuel inlet tube 30 is supported centrally by the plate 28 and extends forwardly to support an apertured cup-shaped flame holder 32. A circular plate baffle 34 is secured about the tube 30 centrally of the length thereof. An igniter 36, also supported from the plate 28, projects angularly into the flame holder 32 and to the front end of the fuel inlet tube 30.

A primary air distribution manifold 38 is provided as an annulus about the fuel inlet tube 30 and extends axially between the plate 28 and a forwardly spaced annular plate 40. A primary air inlet port, defined by a flanged nipple 42, opens through an aperture 44 in the plate 28 to the manifold 38.

A ceramic or refractory body 46 of generally stepped cylindrical configuration is received in the open end of the shell 16 and, as shown in FIG. 2, is shaped at its rear end to complement the interior surface configurations of the shell 16, the hat shaped member 22 and the annular plate 40. The body 46 defines a central burner ignition chamber 48 shown in FIG. 2. The chamber 48 tapers to diverge at a slight angle rearwardly so as to engage the periphery of the apertured flame holder 32. The front end of the chamber 48 converges as a fluid accelerating nozzle with a restricted outlet 50 opening through the front end of the body 46.

Also formed in the ceramic body 46, outwardly from the central chamber 48, are a plurality of secondary air accelerating nozzles 52. In the illustrated embodiment, four such accelerating nozzles 52 are provided as shown in FIG. 1. Each of the nozzles 52 opens at its rear end to the secondary air manifold 20 and converges forwardly to a high velocity nozzle orifice 54 at the front end 12 of the burner as defined by the body 46.

As will be apparent from the description to follow, the burner 10 is intended to be mounted in a furnace wall. To this end, a peripheral mounting flange 56 is secured about the shell 16 generally intermediate the length of the burner.

It is noted that the fuel supply and igniting assembly 26, in itself, is the same as that used in Burner Model SVG 115 sold by Hauck Manufacturing Co. In that burner, the secondary air manifold is not used and the ceramic body is shaped to include only the chamber 48. The assembly 26 is, therefore, interchangeable in the Burner Model SVG 115 and the burner 10 of the present invention.

In FIG. 3 of the drawings, an embodiment of a system for supplying fuel and air to the burner 10 is depicted schematically. As thus shown, fuel, specifically gas in the illustrated embodiment, is supplied from a line 60 through a conventional gas safety manifold 62 to the burner fuel inlet tube 30 by way of a regulator flow line 64. The line 64 includes a manual shut off valve 66, a solenoid shut off valve 68, a gas metering orifice 70, a gas/air ratio regulator 72 and a limiting gas valve 74.

The gas manifold 62 and regulating line 64 are shunted by gas lighting pilot lines 76 and 78. The branch of the pilot gas flow path represented by the line 76 may be common to other burners and is conventionally equipped with a manual cut off valve 80 and a regulator 82. The pilot line 78, which is provided for each burner, includes a solenoid valve 84, a regulator 86 and a limiting gas valve 88.

Air for supporting combustion of fuel at the burner 10 is supplied by a blower 90 to primary and secondary air lines 92 and 94 connected in fluid communication, respectively, with the primary air nipple 42 and secondary air nipple 24 on the burner 10. The primary air line 92 includes a primary air pulse firing control valve 96. Although the operation of the valve 96 in the context of overall system operation will be described in more detail below, it is to be noted that the valve 96 functions on command to either close or open the line 92. Also, the secondary air line 94 is similarly equipped with a secondary air pulse firing control valve 98.

The primary air pulse firing control valve 96 in the primary air line 92 is shunted by a bypass line 100 including an air ratio regulator 102, an air control valve 104, and a solenoid valve 105.

As indicated by dashed lines in FIG. 3, the gas/air ratio regulator 72 in the fuel supply regulating line 64 is controlled in response to air pressure in either of the primary air line 92 or the secondary air line 94. Impulse pressure for this purpose is transmitted by a three-way solenoid valve 106. The pilot line regulator 86 is similarly controlled by pressure in the primary air line 92 as indicated by the dashed line 108 whereas the air ratio regulator 102 in the bypass line 100 is controlled in response to pressure in the secondary air line 94 by way of fluid communication represented by the dashed line 110.

With the exception of the burner 10, the individual flow control components shown in FIG. 3 are conventional, commercially available valves and regulating devices well known to those skilled in the fuel combustion art. For example, each of the solenoid valves 68, 84 and 105 is conventionally actuated between open and closed conditions by a self-contained electric solenoid. Similarly, the air pulse firing control valves 96 and 98 are electrically controlled solenoid valves adapted to be actuated between fully opened or closed conditions. The three-way solenoid valve is actuated in response to an electric signal to place the regulator 72 in fluid communication alternately with the primary and secondary air flow lines 92 and 94, respectively.

Although the regulators 72 and 102 in the respective fuel lines 64 and bypass line 100 are similarly constructed air pressure responsive flow regulators, these regulators are adjustable to different modes of operation. In particular, they may be adjusted to operate between a closed or shut-off condition and variable open conditions, or to operate variably between minimum and maximum open conditions without a capability for full closure. In the embodiment illustrated in FIG. 3, the fuel line regulator 72 is adjusted to operate between a fully closed condition and variable open conditions depending on line pressure in either of the air lines 92 or 94 under the control of the three-way solenoid valve 106. The air ratio regulator 102, on the other hand, is adjusted to operate only in an open condition between minimum and maximum values.

In accordance with the present invention, the burner 10 or its equivalent is operated in one of two modes depending on the temperature of the furnace combustion chamber 114. In each of the two modes, the burner may be operated continuously at maximum heat generating capacity or it may be controlled to meet the temperature demands of the furnace chamber 114 in a manner to be described below. In all conditions of operation, the supply of fuel and air to the burner, coupled with the burner response to that supply, assures a minimum level of $NO_x$ production in the furnace combustion chamber 114.

The furnace combustion chamber transitional temperature which determines which of the two modes of operation is used is dependent primarily on the ignition temperature of the fuel used. However, the transition temperature for a specific fuel may vary as much as several hundred degrees due to differing combustion chamber designs, operating conditions of the furnace and/or different applications. For purposes of illustration, a typical transitional temperature of 1400° F., the approximate ignition temperature of natural gas, may be used.

Figure 4A:
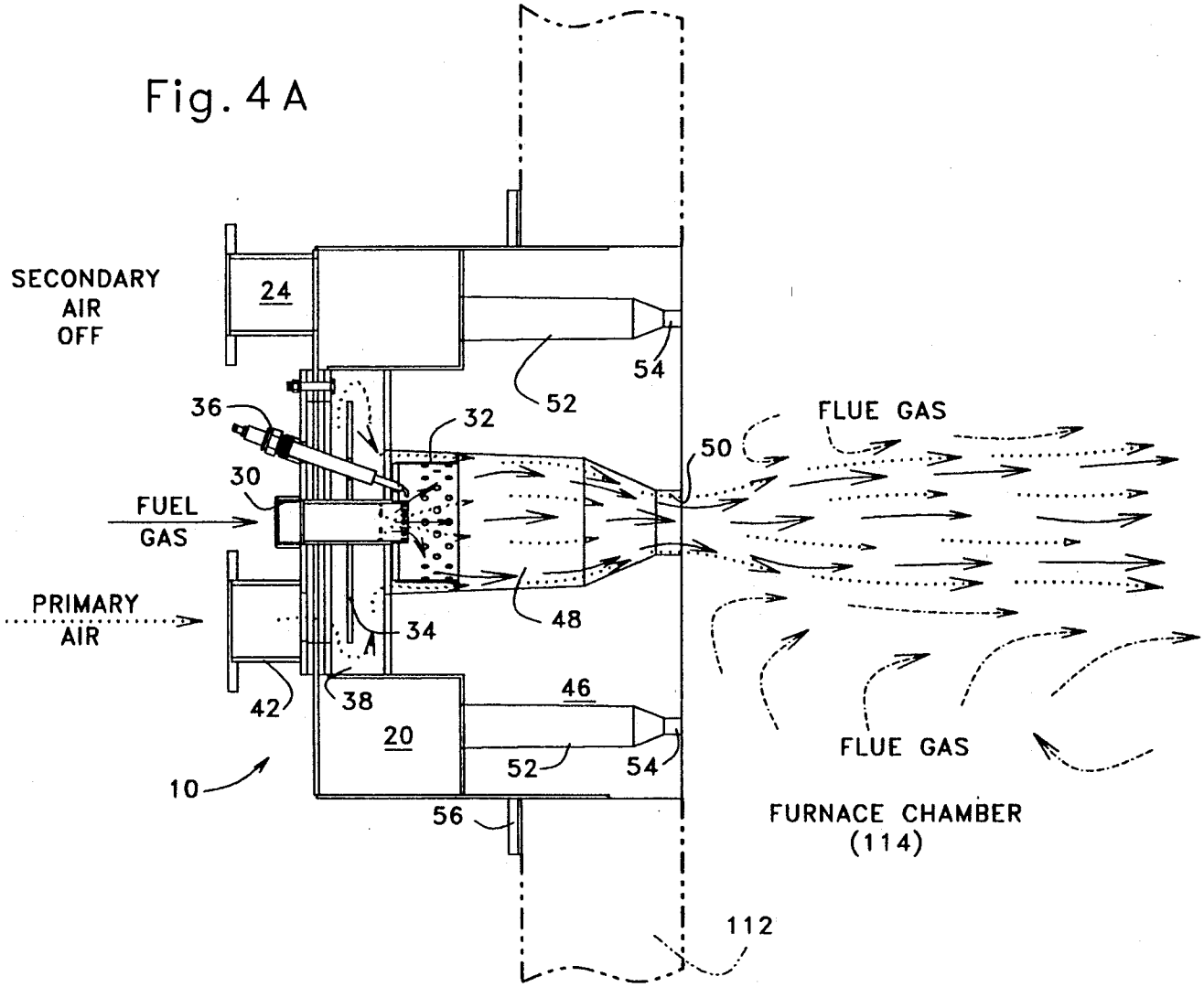
FIG. 4A is a schematic view depicting operation of the burner in one mode.
Figure 4B:
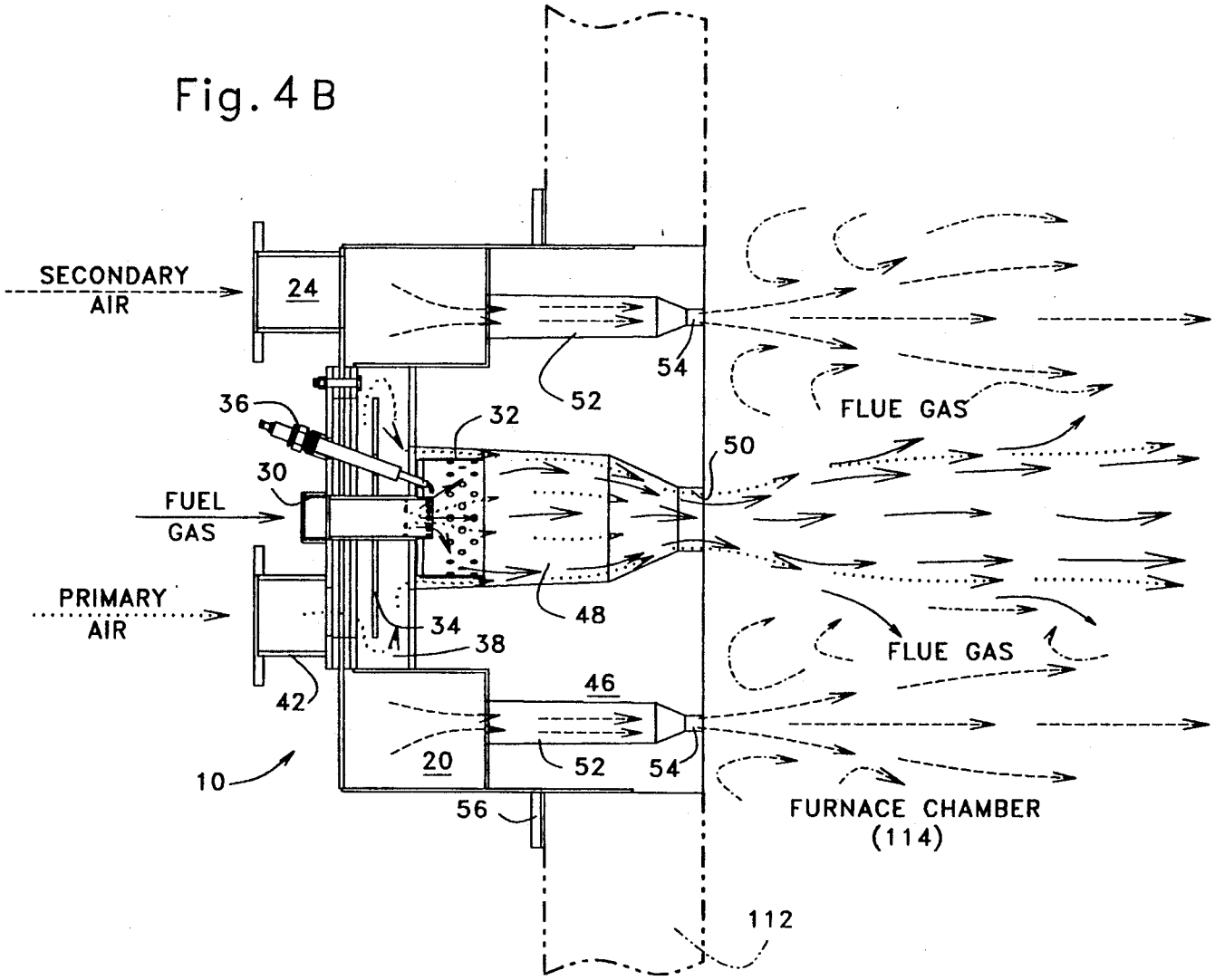
FIG. 4B is a similar schematic view of burner operation in a second mode.

Operation of the illustrated embodiment in the practice of the present invention will be described with reference to FIGS. 3–6 of the drawings. In FIGS. 4A and 4B, the burner 10 is shown mounted in wall 112 forming one end of a furnace combustion chamber 114. Also in these figures, the flow of various fluids through the burner 10 and in the combustion chamber 114 are very generally represented by arrows in differing line form. In particular, the fuel gas flow is represented by solid line arrows; primary air flow is represented by dotted line arrows; secondary air flow is represented by dashed line arrows and flue gas flow in the furnace chamber 114 is represented by double dash-dot lines.

In a first operating mode (Mode A) for furnace combustion chamber temperatures up to the transitional temperature, the burner 10 in the illustrated embodiment is operated with primary air alone to support fuel combustion. During full capacity operation of the burner in Mode A (Mode $A_f$), the air pulse firing control valve 98 in the secondary air line is closed. The solenoid valve 105 in the bypass line is open and the air pulse firing control valve 96 is held open. Both the fuel line 64 and the pilot line 78 are open to pass fuel to the fuel port 30 of the burner. The ratio of fuel/primary air supplied to the burner 10 in this first mode is determined by the ratio regulator 72 under air pressure in the primary air line 92 by appropriate setting of the three-way solenoid valve 106.

As shown in FIG. 4A, fuel gas entering the port 30 is mixed with primary air entering the port 42 to provide a combustible mixture within the flame holder 32 where it may be ignited by the ignitor 36. The mixture during Mode A operation is preferably at a near stoichiometric ratio, that is, the supplied primary air is adequate for stoichiometric or substoichiometric burning of the gas supplied to the port 30. This mixture ratio is accomplished by setting the ratio regulator 72 and the limiting valve 74, and the setting is selected to avoid the introduction of oxygen into the furnace combustion chamber 114.

The combustible mixture of fuel and primary gas ignited at the flame holder 32 expands in the ignition chamber 4 and is accelerated through the restricted opening 50 into the chamber 114. During Mode $A_f$ operation, the temperature in the furnace chamber will increase at rates corresponding to the maximum heat generating capacity of burner operation in Mode A.

If the rates of temperature increase in the chamber 114, for example, are to be reduced from maximum operating capacity in Mode $A_f$, the system is adjusted to a partial capacity Mode A operation (Mode $A_p$). In accordance with the present invention, partial or less than maximum capacity of the burner 10, in both modes of operation, is achieved by using "high fire on/off burner operation" with frequency modulation for temperature control. The term, "high fire on/off burner operation," as used herein and in the appended claims, means that, when on, the burner is supplied with fuel and air in amounts intended to develop the maximum heating capacity of the burner, and that when off, the heating capacity of the burner is zero or essentially zero.

Thus, in Mode $A_p$, when it is desired to reduce the rate at which temperature in the furnace chamber 114 is increased, the burner firing rate is controlled by cycling the primary air pulse firing control valve 96 between timed open and closed conditions. For example, the firing rate of the burner in Mode $A_p$ may be reduced by approximately 50% by cycling the valve 96 to be open for a period of time on the order of 5 or 6 seconds and closed for an equal amount of time. Firing rates lower than or between the exemplary 50% and maximum may be accomplished by varying the length of time the valve 96 is open relative to the length of time it is closed. In this way, the velocity of the burning mixture of fuel and air injected into the chamber 114 from the opening 50 will be essentially the same during operation in a given mode, irrespective of whether the burner is operated at maximum heating capacity or partial heating capacity in that mode.

During Mode $A_p$ operation, the system control components shown in FIG. 3 are the same as described above for full capacity Mode $A_f$ operation with the exception that the solenoid valve 105 is opened and the pulse firing control valve 96 is cycled on and off as described. The open state of the solenoid valve 105 assures that a relatively small amount of primary air is supplied to the burner 10 irrespective of whether the control valve 96 is on or off. In this respect, the regulator 102 is in an opened condition of minimum value due to the absence of air pressure in the secondary line 94.

The amount of primary air supplied through the bypass line 100 is selected to maintain ignition of fuel supplied through the pilot line 78. Thus, while the major amount of primary air is supplied through the line 92 and correspondingly, the major supply of fuel is that passing the regulator 72, both are cycled on and off during Mode $A_p$ operation. The pilot line 78 and the bypass line 100 serve to maintain ignition of a minor supply of pilot fuel and air in the chamber 48 of the burner 10 while no fuel passes the regulator 72 and no primary air passes the control valve 96.

When the temperature in the furnace chamber 114 reaches or exceeds the transition temperature described above, the second mode (Mode B) of burner operation is used as depicted in FIG. 4B. System operation in Mode B parallels operation in Mode A from the standpoint of full (Mode $B_f$) and partial (Mode $B_p$) burner capacities. In Mode $B_f$ operation, the primary air pulse firing control valve 96 is closed and the secondary air pulse firing control valve 98 remains continuously opened. The setting of three-way solenoid valve 106 is adjusted to place the secondary air line 94 in communication with the air/fuel ratio regulator 7 and the solenoid valve 84 in the pilot line 78 is closed. The solenoid valve 105 in the bypass line 100 is opened during Mode $B_f$ operation to supply a minor percentage of primary air to the burner port 42 under the control of the air ratio regulator 102 in dependence of air pressure in the secondary air line 94 via line 110. The air ratio regulator 102 is thus operated to supply primary air in amounts approximating 10% of the air needed for stoichiometric combustion of fuel supplied to the burner 10 by the fuel/air ratio regulator 72, now operating in response to air pressure in the secondary air line 94 via the solenoid 106. The amount of primary air flowing in the bypass line is further controlled by a pre-selected adjustment of the air control valve 104.

It is to be noted that the reduction in the amount of primary air supplied to the ignition chamber 48 during Mode B operation will reduce the velocity of burning gases exiting the nozzle 50 to a relatively low velocity as compared with the moderately high velocities to which the ignited mixture of fuel and air are accelerated from the same nozzle during Mode A operation.

Because operation in Mode B generally assumes that the furnace chamber 114 is at or above fuel ignition temperatures, in reduced or partial capacity Mode $B_p$ operation, the supply of fuel and air to the burner 10 are cycled between on and completely off conditions. The pilot line 78 is off during Mode B operations when the burner is off and cycled with the solenoid valve 105. The fuel supply will by cycled on and off with the pressure in the secondary line 94 upon opening and closing the secondary air pulse firing control valve 98. To assure that primary air is supplied to the burner 10 through the bypass line 100 when the control valve 98 is off or closed, the solenoid valve 105 is cycled on and off in synchronism with the control valve 98 in Mode $B_p$ operation.

As will be appreciated from the illustration in FIG. 4B, during Mode B operation, the amount of primary air supplied to the ignition chamber 48 is adequate only to maintain ignition of fuel supplied to the port 30. The mixture expanded through the opening 50 is therefore extremely rich in fuel. Because the temperature of the furnace chamber 114 during Mode B operation is at or above the ignition temperature of the fuel, a significant amount of fuel combustion occurs downstream from the opening 50 and is supported by the large amounts of secondary air accelerated to high velocity through the nozzle orifices 54. As a result of the relatively high energy flow of gases in the furnace chamber 114, spent combustion products or flue gases are entrained in the burning mixture of fuel and air. Thus, excess oxygen levels in the chamber 14 are kept at a minimum or zero level and $NO_x$ development is minimized.

Figures 5, 6:
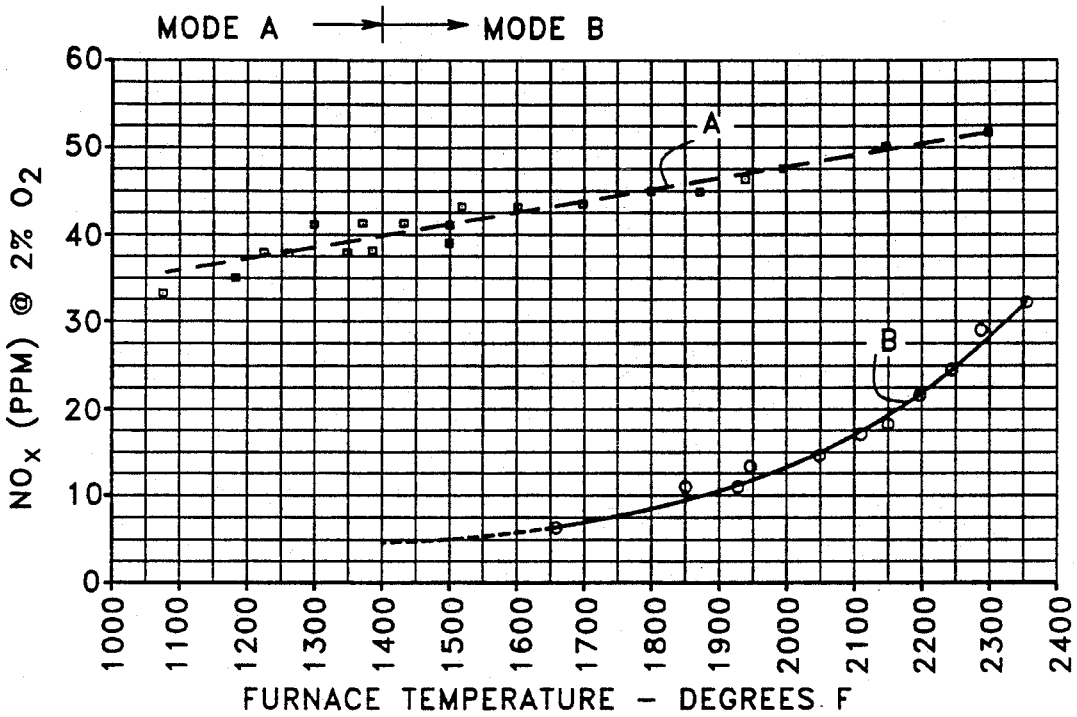
FIG. 5 is a graph representing $NO_x$ formation at varying furnace chamber temperatures for the two modes of operation.
FIG. 6 is a table of fuel air mixture parameters for various modes of operation.

In FIG. 5, curves A and B are representative of Mode A and Mode B operation, respectively. Both curves were developed from test data in which the measured amount of excess oxygen in the furnace chamber was approximately 2% at full burner capacity in each mode. Although performance data at partial capacity with pulsed on/off operation are not shown in FIG. 5, it has been found in practice that the development of $NO_x$ remains essentially the same in both modes whether the burner is operated continuously or frequency modulated through on/off operation.

The curve A in FIG. 5 is extended well beyond the transition temperature of approximately 1400° for comparative illustration purposes and also to confirm the accuracy of the curve at lower temperatures. Further, only the solid line portion of curve B in FIG. 5 was developed from actual test data. The dash line portion of curve B is an estimated extension to the transition temperature between Mode A and Mode B operation.

In FIG. 6, exemplary fuel and air parameters are given in numerical values of cubic feet per hour at 70° F. for Mode A, Mode $B_f$, and Mode $B_f$(50%), respectively. Air pressures at the respective primary and secondary air manifolds (38 and 2 respectively in the illustrated embodiment) are given in inches of water. The velocity of gases exiting the apertures 50 and 54 of the burner is not shown in FIG. 6. While the precise velocity of gases exiting the nozzle 50 is variable depending on the conditions of combustion in the chamber 48, the velocity of air exiting the secondary air nozzles 54 at 4300 cubic feet per hour approximates 282 feet per second.

As is particularly evident from the curves of FIG. 5, the operation of the burner in the two modes described significantly enhances the reduction of $NO_x$ at high furnace temperatures where $NO_x$ has been traditionally a problem. Yet the combination of operational modes enables lower furnace temperatures as may be required by various furnace processes and also as may be required to hold a furnace chamber at a relatively low temperature for varied periods of time.

The foregoing description of preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A method for operating a high velocity burner in a furnace combustion chamber throughout a range of operational combustion chamber temperatures after burner start-up to minimize formation of $NO_x$ in the chamber, comprising the steps of:

operating the burner in a first mode of the two modes by accelerating a burning mixture of fuel and primary air to moderately high velocities into the chamber at operational chamber temperature to ensure a mixing of the flue gases with the burning mixture of fuel and primary air; and thereafter operating the burner in a second mode of the two modes by introducing into the chamber a relatively low velocity stream of burning fuel mixed with a small amount of the primary air sufficient for stoichiometric combustion at furnace combustion temperatures above said predetermined operational temperature and accelerating a separate stream of secondary air comprising the remainder of air required for stoichiometric fuel combustion to high velocities into the furnace combustion chamber for mixture with said low velocity stream downstream from the burner in the furnace combustion chamber.

2. The method recited in claim 1 wherein said predetermined operational temperature is above the minimum ignition temperature of the fuel.

3. The method recited in claim 1 comprising the step of controlling the heating capacity of the burner at least in said second mode by on/off frequency modulation of maximum burner firing rates.

4. The method recited in claim 1 comprising the step of controlling the heating capacity of the burner in both said modes by frequency modulation of maximum burner firing rates.

5. The method recited in claim 4 wherein said controlling step comprises controlling the heating capacity of the burner in said first mode by frequency modulation of burner firing rates between maximum firing rates and a pilot supply of fuel and air, thereby to maintain continuous ignition of fuel and air during said first mode.

6. The method recited in claim 1 wherein said minor amount of air comprises approximately 10% of air required for stoichiometric combustion of the fuel.

7. The method recited in claim 1 wherein the high velocities of said separate stream of air approximate 280 feet per second.

8. The method recited in claim 7 wherein said separate stream of air is substantially parallel to said relatively low velocity stream of fuel.

9. The method recited in claim 7 wherein said separate stream of air substantially surrounds said relatively low velocity stream of fuel.

10. A method for operating a high velocity furnace combustion chamber burner having an ignition chamber for discharging an ignited combustible mixture of primary air and fuel into the furnace combustion chamber, and at least one nozzle port for directing a high velocity stream of secondary air into the furnace combustion chamber in a direction generally parallel to the direction of flow from said ignition chamber, said method comprising the steps of:

supplying fuel to the ignition chamber of the burner;

supplying primary air to the burner during plural modes of burner operation including a first mode during which primary air alone is supplied to the burner ignition chamber up to a predetermined operational temperature of the chamber and a second mode above the predetermined operational temperature during which primary air is a minor percentage of air used for stoichiometric combustion of fuel supplied to said burner so as to introduce a low velocity stream into the combustion chamber;

supplying secondary air in amounts constituting a major percentage of air required for stoichiometric combustion of fuel during said second mode;

regulating said fuel supplying means so that fuel supply to said burner is supplied in desired amounts during said first mode and also in desired amounts during said second mode; and controlling the heating capacity of said burner at least during said second mode by intermittently terminating operation of said secondary air supplying means for variable periods of time.

11. The method recited in claim 10 comprising controlling the heating capacity of said burner also during said first mode by high fire on-essentially-off frequency modulation of said primary air supplying means.

12. A high velocity burner system for furnace combustion chambers, said system comprising:

a burner having an ignition chamber for discharging an ignited combustible mixture of primary air and fuel into the furnace combustion chamber, and at least one nozzle port for

13. The burner system recited in claim 12 wherein said means for controlling the heating capacity of said burner further includes primary valve means for intermittently terminating operation of said primary air supplying means for variable periods of time in synchronism with said means for terminating operation of said secondary air supplying means.

14. The burner system recited in claim 12 including means for regulating said primary air supplying means in dependence on secondary air supplied to said burner during said second mode.

15. The burner system recited in claim 12 including means for controlling the heating capacity of said burner also during said first mode and including primary control valve means adjustable between open and closed conditions for high fire on/off frequency modulation of said primary air supplying means.

16. The burner system recited in claim 15 wherein said means for controlling the heating capacity of said burner during said first mode includes means for bypassing primary air around said primary control valve means at reduced rates to maintain an ignited mixture of fuel and air in said burner when said primary control valve means is in a closed condition.

17. A high velocity gas burner for a furnace combustion chamber, said burner comprising:

a ceramic body defining a central burner ignition chamber converging to an accelerating nozzle and a plurality of secondary air accelerating nozzles surrounding and generally parallel to said first-mentioned accelerating nozzle;

a fuel inlet tube opening to said burner ignition chamber;

means defining a primary air distribution manifold about said fuel inlet tube and in fluid communication with said burner ignition chamber;

means defining a secondary air distribution manifold in communication with said secondary air accelerating nozzles and surrounding said primary air distribution manifold; and means for supplying primary air to the burner for first and second modes of operation subsequent to burner start-up and for supplying secondary air to the burner for said second mode such that primary air alone is supplied to the ignition chamber up to a predetermined operational temperature of the combustion chamber in said first mode and thereafter, in said second mode when the combustion chamber exceeds the predetermined operational temperature, is a minor percentage of air used for stoichiometric combustion of fuel to introduce a low velocity stream of burning fuel into the furnace combustion chamber while secondary air constitutes a major percentage of air required for stoichiometric combustion of fuel whereby the production of $NO_x$ is minimized.

* * * * *